United States Patent [19]

Toriumi et al.

[11] Patent Number: 4,572,648

[45] Date of Patent: Feb. 25, 1986

[54] IMAGE FORMING APPARATUS

[75] Inventors: Mototada Toriumi, Yokohama; Shinji Kanemitsu, Ichikawa, both of Japan

[73] Assignee: Canon Kabushiki Kaisha, Tokyo, Japan

[21] Appl. No.: 534,311

[22] Filed: Sep. 21, 1983

[30] Foreign Application Priority Data

Sep. 30, 1982 [JP] Japan ..... 57-171917

[51] Int. Cl.[4] ..... G03G 15/00

[52] U.S. Cl. ..... 355/3 FU; 355/3 SH; 355/14 FU; 355/14 SH

[58] Field of Search ..... 355/3 TR, 3 FU, 3 SH, 355/14 SH, 14 TR; 219/216; 271/3, 188

[56] References Cited

U.S. PATENT DOCUMENTS 4,234,305 11/1980 Miyake et al. ..... 355/3 SH X
4,380,385 4/1983 Ozaki et al. ..... 355/3 TR
4,389,114 6/1983 Westerman ..... 355/3 SH X
4,411,511 10/1983 Ariyama et al. ..... 355/3 TR
4,419,003 12/1983 Fujie et al. ..... 355/3 SH X

*Primary Examiner*—A. C. Prescott
*Attorney, Agent, or Firm*—Fitzpatrick, Cella, Harper & Scinto

[57] ABSTRACT

An image forming apparatus wherein an image is fixed by transporting through a nip of fixing rollers. The nip is inclined with respect to a direction perpendicular to the direction of movement of the transfer material toward the fixing rollers. The inclination is such that the part of the nip engageable with that one lateral end of the transfer material which is acted on by the separating mechanism is upstream as compared with the part of the nip engageable with the other lateral end which is not acted on by the separating mechanism with respect to the movement of the transfer material toward the fixing rollers.

5 Claims, 5 Drawing Figures

IMAGE FORMING APPARATUS

BACKGROUND OF THE INVENTION

1. Field of the Invention

The present invention relates to an image forming apparatus, such as an electrophotographic copying machine or printer.

2. Description of the Prior Art

Conventionally, coupled rollers for fixing an image in an image forming apparatus, such as an electrophotographic copying apparatus or the like, is so disposed that the nip formed by the coupled rollers extends parallel with an axis of a photosensitive drum. The photosensitive drum receives a transfer material, at its image transfer station, so that the leading edge of the transfer material is parallel with the axis of the photosensitive drum, or perpendicular to the direction of the transfer material movement. The transfer material receives an image from the photosensitive drum at the image transfer station and then is conveyed to coupled fixing rollers by suitable conveying means, while the leading edge thereof is kept parallel with the axis of the photosensitive member. The leading edge is then gripped by the nip of the rollers uniformly over the length of the nip, and the transfer material is subjected to the image fixing operation, whereafter it is discharged to a tray. Thus, the leading edge of the transfer material moves, at all times, parallel to the axis of the photosensitive drum and the nip of the fixing rollers.

Recently, there is a trend of reducing the size and cost of the image forming apparatus, which leads to decreasing the distances between the transfer material feeding roller, the registering rollers, the photosensitive drum, the separating roller, the conveying rollers and the fixing rollers, respectively. The decrease in such distances results in the stricter confinement on the transfer material. Particularly, the size reduction necessiates the decrease of the distance between the transfer material separating station to the fixing station. To secure a certain distance therebetween, the passage of the transfer material has to be curved, not straight. Further, when the transfer material is conveyed with only one of its lateral ends being guided along a predetermined path, the leading edge of the transfer material may be gripped unevenly over the nip. This may result in wrinkles in the transfer material, the jamming thereof or other various troubles caused by the wrinkles.

SUMMARY OF THE INVENTION

Therefore, it is a principal object of the present invention to provide a small size and low cost image forming apparatus wherein there are no wrinkles or jamming of the transfer material at the image fixing station.

According to the present invention, an image forming apparatus comprising, an image bearing member, means adapted to be engaged with one lateral end portion of the transfer material to separate the transfer material from the image bearing member, means for conveying a transfer material separated by the separating means, and a couple of fixing rollers, forming a nip, for receiving the transfer material from the conveying means and fixing an image on the transfer material, the nip extending inclinedly with respect to a direction perpendicular to the direction of movement of the transfer material to the fixing rollers, wherein that part of the nip which is engageable with the said one lateral end of the transfer material, is upstream of that part of the nip which is engageable with the other lateral end of the transfer material with respect to the movement of the transfer material toward the fixing means.

These and other objects, features and advantages of the present invention will become more apparent upon a consideration of the following description of the preferred embodiment of the present invention taken in conjunction with the accompanying drawings.

DESCRIPTION OF THE PREFERRED EMBODIMENTS

Figure 1:
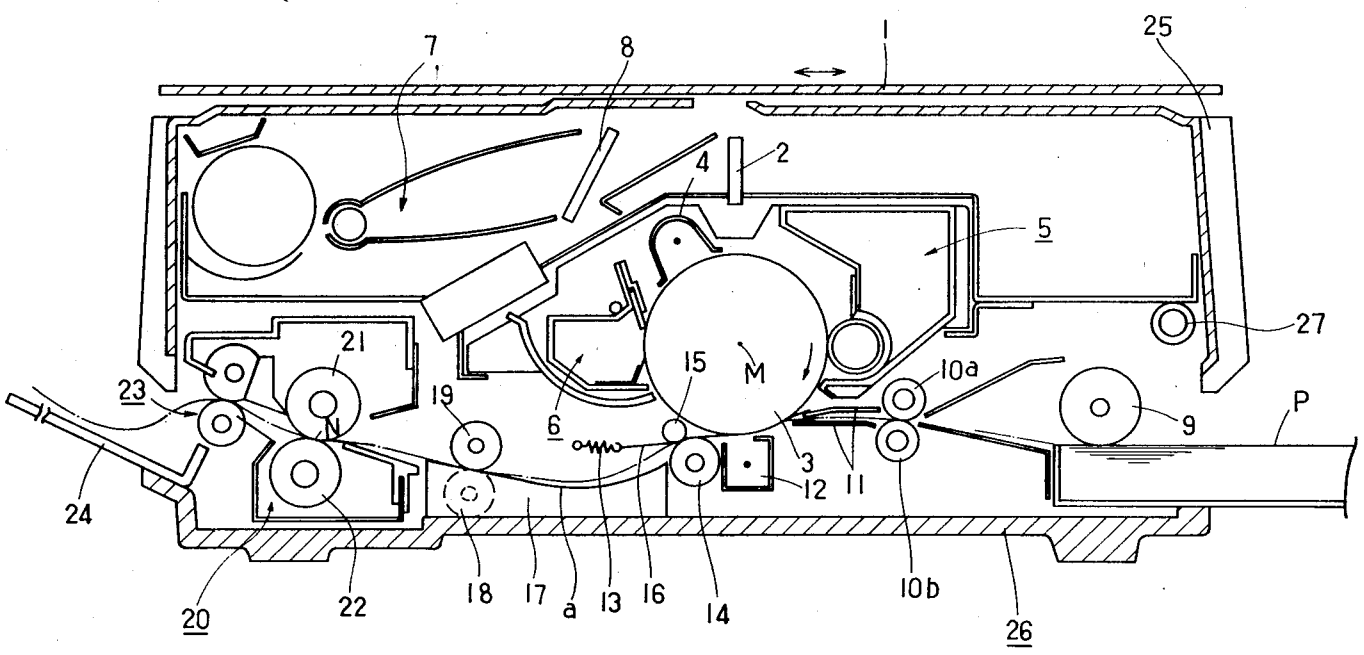
FIG. 1 is a cross-sectional view of an image forming apparatus according to an embodiment of the present invention.

Referring now to FIG. 1, there is shown an electrophotographic copying machine, as an example of the image forming apparatus according to an embodiment of the present invention, which includes an original carriage 1 of a transparent material and reciprocable in the directions shown by the arrow, a converging light transmitting device 2 for projecting light images, a photosensitive drum 3, as an image bearing member, having a photosensitive layer and rotatable about its axis M in the direction shown by an arrow. The photosensitive drum 3 is slit-exposed to the light image through the light transmitting device 2.

The apparatus further includes a corona discharger 4 for applying uniform charge on the surface of the photosensitive drum 3. A latent image is formed by applying the light image to the photosensitive drum 3 after the uniform charging. The apparatus is provided with developing means 5 for developing the thus formed latent image with toner particles. The toner particles remaining on the photosensitive drum 3 are removed by cleaning means 6. The electrophotographic apparatus further includes light source means 7 for illuminating the original to be copied and a filter 8 for absorbing thermic rays.

A transfer material P is fed out by a feeding roller 9 and timed by register rollers **10*a* and 10*b* to be further fed, in synchronism with the other parts of the apparatus, through the transfer material guide 11 to the surface of the photosensitive drum 3. The transfer material P receives there the toner image from the photosensitive drum 3 under the action of the transfer discharger 12. Then, it is separated from the photosensitive drum 3 by the separating means 16 shown as a separating belt in the Figure. The separating belt 16 is stretched by a spring 13 and urged to the marginal area, i.e., non-image forming area of the photosensitive drum 3 adjacent one longitudinal end portion thereof. The separated transfer material P is gripped, at its one lateral end, by the separation roller 14 and the separation roll 15 and conveyed to the transfer material guide 17, and then further gripped and conveyed by the conveying roller 18 and the conveying roll 19 to image fixing means 20. The toner image on the transfer material P is heated and fixed by the fixing rollers 21 and 22, while being conveyed through the nip formed by the rollers 21 and 22**.

The transfer material P is then discharged by the discharging roller 23 to the tray 24.

In order to reduce the size of the image forming apparatus and also in order to allow the use with a small size transfer material, the distance between the adjacent rollers along the passage of the transfer material P is desired to be smaller. As an example, the distance between the transfer material separating position to the conveying roller is 85 mm which is smaller than the length of the transfer material used with the apparatus. The transfer material passage 17 therebetween is curved, as shown by reference character a, to allow the conveyance of a rigid transfer material P. In this example, the diameter of the photosensitive drum 3 is 60 mm.

The apparatus is divisible into an upper body 25 and a lower body 26. More particularly, the upper body 25 is rotatable about the shaft 27 to open the upper part of the lower body 26. The upper body 25 contains various image forming means, while the lower body 26 contains the transfer material conveying mechanism, the image transfer means 12 and the fixing means 20. The fixing means 20 is detachably mountable into the lower body 26 of the apparatus.

Figure 2:
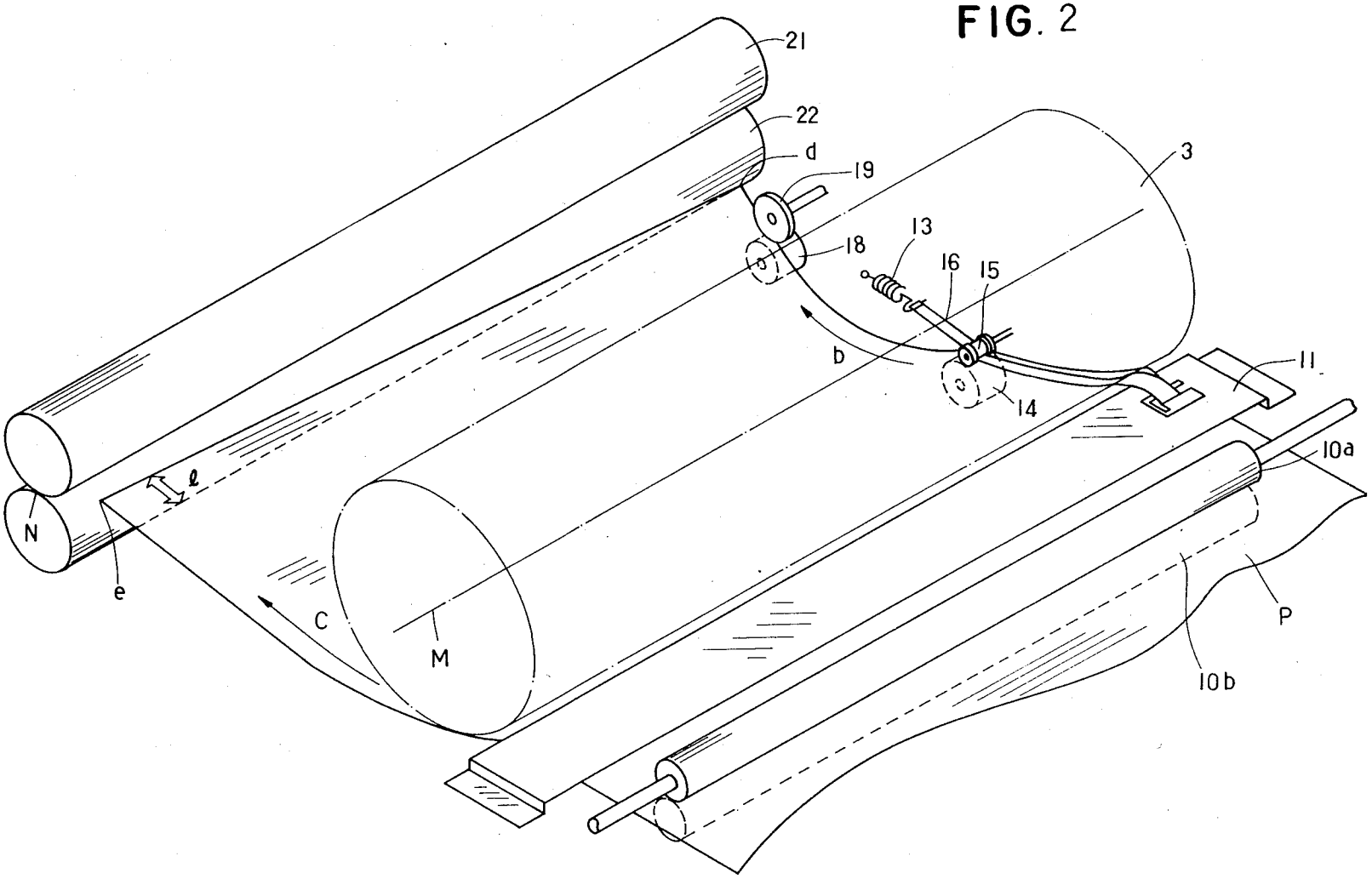
FIG. 2 is a perspective view of a part of the apparatus of FIG. 1 showing the action of the transfer material.

FIG. 2 shows the state of the transfer material P which is about to be gripped by the fixing rollers 21 and 22. The leading edge of the transfer material P, after having been passed through the register rollers 10*a* and 10*b*, advances with its leading edge parallel with the axis M of the photosensitive drum 3, until it reaches the separating roller 14 and the separating roll 15. When the leading edge of the transfer material P reaches the position immediately before the fixing rollers 21 and 22, the transfer material P is placed in such a condition that it is confined, at its part near the trailing edge and its part near the lateral end which is engaged by the separating means 16, by the register rollers 10*a*, 10*b*, the photosensitive member 3, the separating belt 16, the separating roller 14, the separating roll 15, the transfer material guide 17, the conveying roller 18 and the conveying rolls 18 and 19. That lateral end of the transfer material P which is acted on by the separating means 16, is confined by the separating means 16 and the conveying means 19, so that such lateral end is curved in substantial conformity with the passage a, as shown by arrow b in FIG. 2. On the other hand, the other lateral end, that is, the lateral end which is not engaged with the separating means 16 tends to keep in longer contact with the photosensitive drum surface 3 than said one lateral end, since the separating action by the separating means 16 does not directly act on this side, and there is a delay from the time when a certain part of the separation side of the transfer material P separates from the photosensitive drum 3 to the time when the corresponding part of the non-separation side separates from the drum 3. For this reason, the non-separation side of the transfer material P tends not to conform with the passage a (FIG. 1), rather it tends to be straight as shown by arrow c in FIG. 2. Since the trailing edge of the transfer material P is still gripped by the register rollers 10*a* and 10*b* parallel with the axis M of the photosensitive drum 3, the non-separation side e of the leading edge of the transfer material P advances further than the other side leading edge e by the distance l, which is, for example, approx. 1.2 mm. Therefore, the fixing rollers 21 and 22 grip first the non-separation side e of the leading edge of the transfer material P, and then gradually grip the leading edge toward the separation side leading edge d, so that the transfer material P is gripped and fed inclinedly. Then, the transfer material P is forced to advance obliquely by the fixing rollers 21 and 22, while confined by the separating means 16 at the separation side lateral end, and by the register rollers 10*a* and 10*b* adjacent its trailing end. In other words, the transfer material P is contradictorily confined at three different points, with the result of wrinkling in the transfer material P. In an extreme case, the non-separation side e of the leading edge extends forwardly and rises up above the nip of the fixing rollers 21 and 22, with the result that the transfer material P is not properly gripped by the fixing rollers so that it jams.

In addition, with the transfer material P forced to advance by the nip of the fixing rollers 21 and 22, a strain is stored in the transfer material P, since it is confined by the different three points unharmoniously. At the moment when the trailing edge of the transfer material P passes through the nip of the register rollers 10*a* and 10*b*, the transfer material P is suddenly released from the register rollers, i.e., from one of the confinements, so that the trailing edge instantaneously displaces because of the stored strain. The sudden displacement of the trailing end may cause a deviation of the image or a missing of a part of the image on the transfer material P, thus making the image transfer unreliable.

Figure 3:
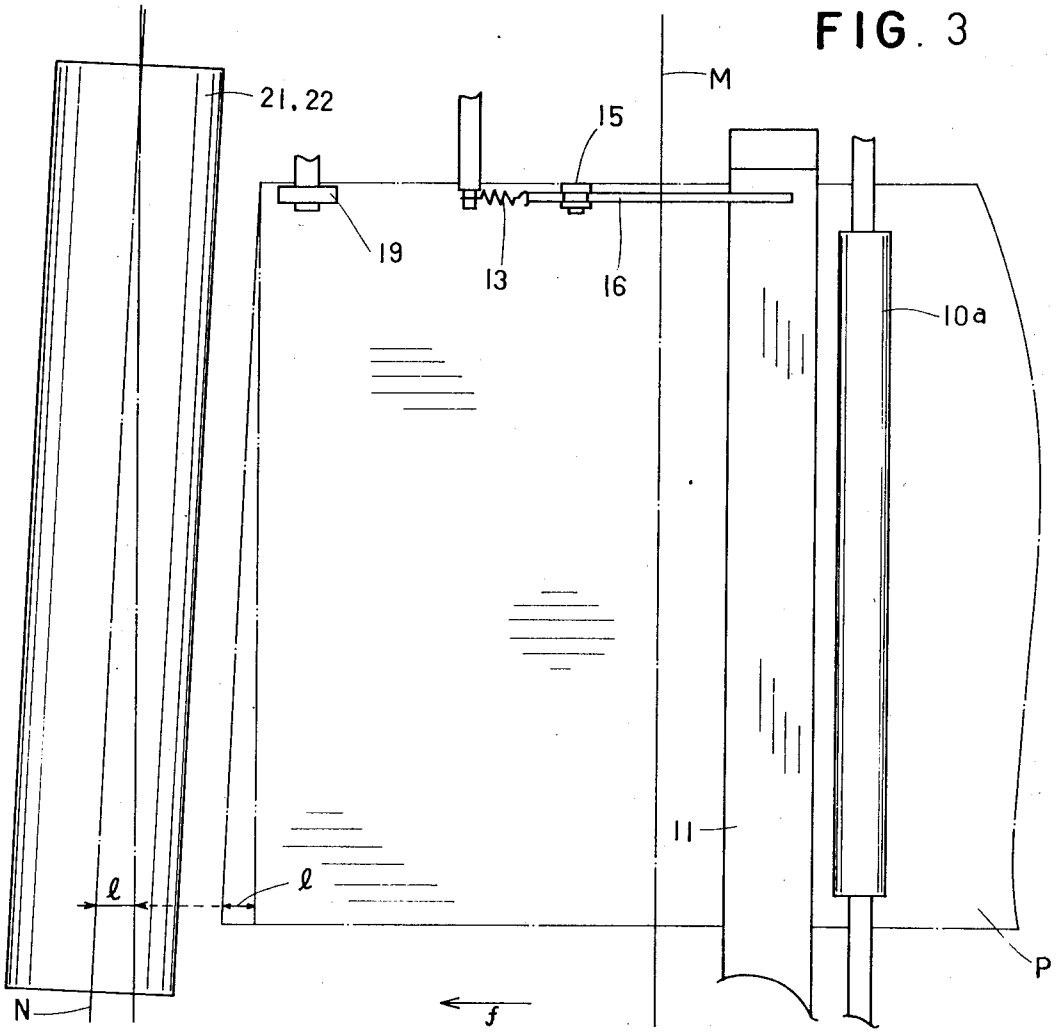
FIG. 3 is a plan view of a passage of the transfer material in the apparatus of FIG. 1.
Figure 4A:
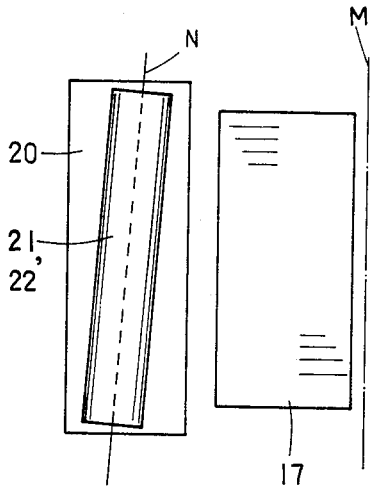
FIG. 4A and FIG. 4B are plan views of the fixing device used with the present invention.
Figure 4B:
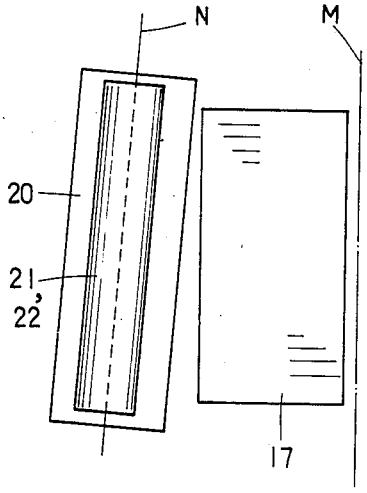

To solve those problems, the present invention deliberately inclines the direction of the nip N of the fixing rollers 21 and 22 with respect to the direction perpendicular to the direction f of the movement of the transfer material, as shown in FIG. 3. The inclination is such that the part of the nip N engageable with the separation side of the leading edge is upstream as compared with the part of the nip N engageable with the non-separation side thereof with respect to the movement of the transfer material P toward the fixing means. So, the nip N is inclined by such an amount l as to meet the difference of conveyance between the non-separation side and the separation side. By doing so, the on-coming leading edge of the transfer material P is substantially uniformly caught by the nip N of the fixing rollers, and during the image fixing operation, the transfer material P is uniformly fed without undue confinement thereonto. Therefore, the wrinkle or the jam can be avoided.

In order that the couple of the fixing rollers is inclined, the rollers may be inclined with respect to the fixing unit, or the unit itself may be inclined while keeping the unit and rollers parallel.

In the embodiment of the present invention described in the foregoing paragraphs, the separation of the transfer material P from the photosensitive drum 3 is effected by a separation belt 16. However, the problems solved by the present invention arises also when a separating pawl or the like is used, as long as the transfer material P is separated and driven at one of its lateral sides. Therefore, the present invention is applicable to such cases.

As described hereinbefore, the present invention can eliminate the occurrence of the wrinkles in and the jamming of the transfer material P. Moreover, the occurrence and concentration of the strain in the transfer material P which may be caused by the inclination of the leading edge thereof, can be eliminated. Thus, a stable image transfer operation can be assured without the distortion, partial missing and double printing of the transferred image.

Although the foregoing explanation is made with respect to the transfer of the developed image, it will be readily understood that the present invention is applicable to the latent image transfer type. Also, the present invention is applicable pressure fixing rollers as well as the described heat fixing rollers.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

means adapted to be engaged with only one lateral end portion of the transfer material to separate the transfer material from said image bearing member;

means for conveying a transfer material separated by said separating means; and a couple of fixing rollers, forming a nip, for receiving the transfer material from said conveying means and fixing an image on the transfer material, the nip extending inclinedly with respect to a direction perpendicular to the direction of movement of the transfer material to said fixing rollers, wherein that part of the nip which is engageable with said one lateral end of the transfer material, is upstream of that part of the nip which is engageable with the other lateral end of the transfer material with respect to the movement of the transfer material toward said fixing rollers.

2. An apparatus according to claim 1, wherein said conveying means includes conveying rollers engageable with said one end of the transfer material.

3. An apparatus according to claim 2, wherein the distance, measured along the direction of movement of the transfer material, between said separating means to said conveying means is shorter than the length of the transfer material.

4. An apparatus according to claim 2, wherein said separating means includes a separating belt.

5. An apparatus according to claim 1, wherein said fixing means fixes the image by said fixing rollers contacting and heating it.

* * * * *